United States Patent [19]

Madaffari

[11] Patent Number: 4,837,833

[45] Date of Patent: Jun. 6, 1989

[54] MICROPHONE WITH FREQUENCY PRE-EMPHASIS CHANNEL PLATE

[75] Inventor: Peter L. Madaffari, Elgin, Ill.

[73] Assignee: Industrial Research Products, Inc., Elk Grove Villiage, Ill.

[21] Appl. No.: 146,483

[22] Filed: Jan. 21, 1988

[51] Int. Cl.[4] ..... H04R 25/00; H04R 1/20

[52] U.S. Cl. ..... 381/69; 181/129; 181/158; 181/161; 381/153; 381/154; 381/158; 381/161; 381/168; 381/174

[58] Field of Search ..... 381/68, 69, 153, 154, 381/158, 159, 161, 168, 174; 181/129, 130, 158, 161, 162

[56] References Cited

U.S. PATENT DOCUMENTS

| | | | |
|---|---|---|---|
| 3,014,099 | 12/1961 | Fiala | 181/158 |
| 3,124,663 | 3/1964 | Beaudry | 181/158 |
| 3,159,719 | 12/1965 | Weiss | 181/158 |
| 3,168,934 | 2/1965 | Wilson | 181/158 |
| 3,381,773 | 5/1968 | Schenkel | 181/158 |
| 3,588,383 | 2/1970 | Carlson | 381/201 |
| 3,963,881 | 6/1976 | Fraim et al. | 381/158 |
| 4,006,321 | 2/1977 | Carlson | 381/158 |
| 4,450,930 | 5/1984 | Killion | 181/158 |

*Primary Examiner*—Jin F. Ng
*Assistant Examiner*—Danita R. Byrd
*Attorney, Agent, or Firm*—Wallenstein, Wagner & Hattis, Ltd.

[57] ABSTRACT

A high frequency emphasis microphone particularly adapted to a hearing aid application provides a steeply rising frequency response characteristic relative to frequency, and has a low pass sonic attenuator for providing to the undriven side of the microphone diaphragm a sonic counterpressure which at low frequencies substantially cancels ambient sound pressure delivered to the driven side of the diaphragm, the attenuator reducing this counterpressure at elevated frequencies to provide accentuated high frequency response. The attenuator includes a pair of inertance-forming restricted passageways passing a portion of incoming sound to a bypass port leading to the undriven side of the diaphragm, the passageways being defined by a U-shaped plate disposed within a chamber confronting the driven side of the diaphragm.

8 Claims, 1 Drawing Sheet

MICROPHONE WITH FREQUENCY PRE-EMPHASIS CHANNEL PLATE

DESCRIPTION

1. Technical Field

The technical field of the invention is electrical transducers, and in particular miniature electrical microphones for hearing aids.

2. Background Prior Art

The present invention is an improved design of an acoustical network whose function is to provide, when incorporated into a microphone, the transduction of sound to an electrical output wherein the higher frequencies have a greater signal level with respect to the lower frequencies. Attempts to produce this effect exist in prior art. They normally employ the base structure of a microphone assembly wherein a housing having a cavity is separated into first and second principal chambers by a diaphragm, and further include a microphone transducer element disposed to be actuated by movement of this diaphragm. Ambient sound enters the first chamber through an input port without significant attenuation. A portion of this incoming sound is passed through an aperture to enter an otherwise sealed second chamber. Sound entering this second chamber ultimately travels to the opposite side of the diaphragm. The dimensions of the passage are chosen so that at relatively low frequencies there is relatively little acoustical attenuation in this second branch, with the result that a significant pressure cancellation occurs at the main diaphragm so as to suppress the microphone response at these lower frequencies. At higher frequencies the attenuation in this second branch becomes significantly greater, resulting in a significant reduction of the counterpressure produced in the second chamber and hence a substantially increased high frequency output.

One such attempt to produce this effect in prior art designs uses a simple hole of a predetermined size passing through the diaphragm. If the aperture is sufficiently small or the sonic frequency is sufficiently low, then the acoustic impedance is predominantly resistive and the frequency response will rise at 6 d.B. per octave. As the size of the aperture is increased the suppression of the lower frequencies is increased, but as long as the impedance continues to remain resistive, the response characteristic will rise with frequency at the rate of six d.B. per octave. For hearing-impaired individuals whose loss increases with frequency, the relative emphasis of the high frequencies will improve their ability to hear and understand speech. For those individuals whose hearing loss is precipitous at the higher frequencies but is only mildly diminished at the lower frequencies an increased high frequency emphasis would be beneficial.

A large enough aperture will have an impedance which is largely inductive at higher frequencies. In this range the slope of the response will approach 12 d.B. per octave, increasing from 6 d.B. per octave at the lower frequencies. In general, however, a simple aperture in a diaphragm is a poor inductor. To achieve a low enough resistance, the size of the aperture becomes so large that the inductive component is reduced to such a low value that the turnover point of the response characteristic occurs at too high a frequency.

To provide a passage that is predominantly inductive, there has appeared in prior art the use of a tube in place of the simple aperture, sometimes referred to as a "Thuras" tube. While such a structure can be made highly effective, it requires a certain minimum length dependent upon the compliance of the diaphragm through which it passes and the size of the chamber it enters. In general the tube must become longer as the microphone becomes smaller. Previous attempts to employ such a simple tube to provide the necessary frequency variation of response resulted, in the smallest achievable embodiment, in an overall case dimension of approximately 7.9 by 5.6 by 4.1 millimeters. Such a structure is disclosed in U.S. Pat. No. 3,588,383 issued to Carlson, Cross, and Killion. Attempts to further miniaturize microphones of this general design proved unsuccessful beyond such a limit principally because of the fact that the relatively short sound-attenuating passages of the second acoustical branch referred to above could not be shortened while still providing the desired resonance point, namely in the vicinity of 2 kilohertz.

Thus, prior to the instant invention there remained a need for a microphone providing the general frequency characteristics of highly attenuated low frequencies, while overcoming the above-mentioned disadvantage thereof.

SUMMARY OF THE INVENTION

The present invention is an improvement over the above-mentioned frequency-dependent attenuating networks in that the present design can achieve the same frequency response in a physically smaller unit. As in the prior art, ambient sound is admitted to a first chamber formed by the diaphragm and case. According to a feature of the invention a U-shaped plate is interposed generally between the diaphragm and case so as to divide the first chamber into an inner open region (excitation chamber) and two peripheral side passageways (transfer chambers). The inner open region allows access of sound to the central portion of the transducer diaphragm without significant attenuation. The outer passageways are bounded on two adjacent sides by the case. A third wall is formed by the U-shaped plate and the final wall is the diaphragm itself. These passages have a common termination in a bypass port which conducts sound around the diaphragm to the other side. These outer passageways provide the acoustic inductance (inertance) required to produce the steeply rising characteristic response shape and the proper turnover frequency. By using existing structures for three of the four side walls of the outer passages, a more efficient use is made of the reduced volume of a smaller transducer.

According to a further feature of the invention, in addition to serving as part of the sound passageway, the U-shaped plate provides a second function of serving as an aligning spacer and support for the diaphragm. Other features and aspects of the invention will become apparent upon making reference to the specifications, claims, and drawings to follow.

DETAILED DESCRIPTION

Figure 2:
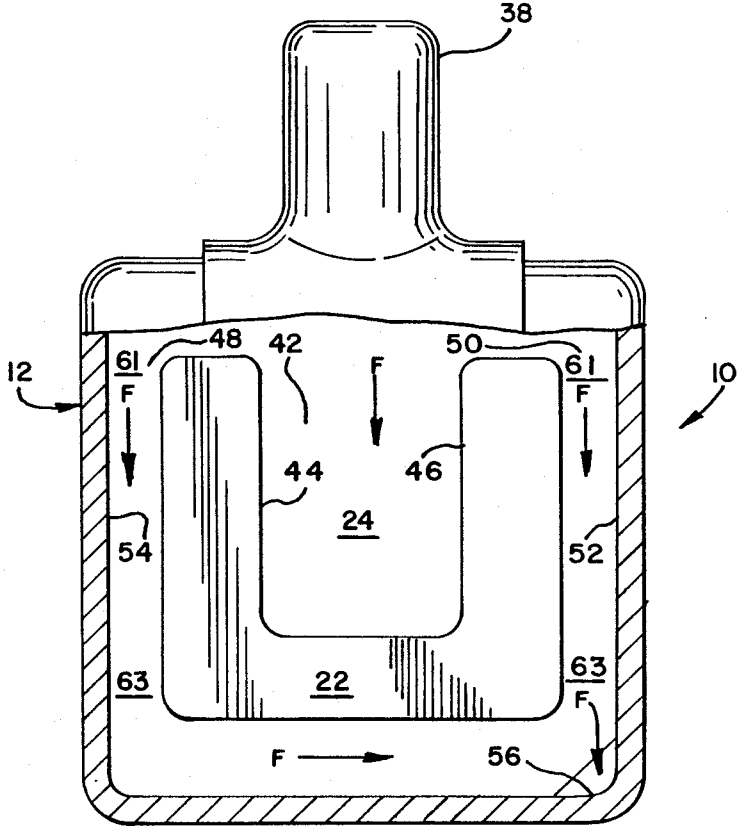
FIG. 2 is a partially cut-away plan view of the microphone assembly shown in FIG. 1.

While this invention is susceptible of embodiment in many different forms, there is shown in the drawings and will herein be described in detail preferred embodiments of the invention with the understanding that the present disclosure is to be considered as an exemplification of the principles of the invention, and is not intended to limit the broad aspect of the invention only to the embodiments illustrated.

Referring now to the figures, the structure of the microphone assembly 10 of the present invention comprises a case or housing 12, which, in the embodiment shown, is square in shape and has depending walls 14. A plate 16 supports a circuit board 18. An electrical amplifier (not shown) is constructed on this board 18, which carries printed stripe terminals on one face 20 connected to the amplifier to protrude to the outside. A U-shaped plate 22 is attached to the inner face of the main housing 12. This element serves as a support for the diaphragm assembly, as will be subsequently described.

A diaphragm assembly consisting of a compliant conducting diaphragm 24 peripherally attached to a mounting ring 26 is affixed to the housing interior by glue fillets 28 to be held in a position where the diaphragm confrontingly contacts the U-shaped plate 22. The glue fillets 28 and that portion of the diaphragm mounting ring 26 in the vicinity of an inlet passage 30 effectively seal off the interior structure of the microphone assembly 10 to the right of the diaphragm 24 from the inlet passage 30. An electret assembly consisting of a backing plate 32 coated with an electret film 34 is corner mounted by adhesive fillets 36 to the mounting ring 26 so as to be in contacting engagement at peripheral portions with the diaphragm 24. This portion of the diaphragm 24 is relatively stiff and unresponsive to sound.

Figure 1:
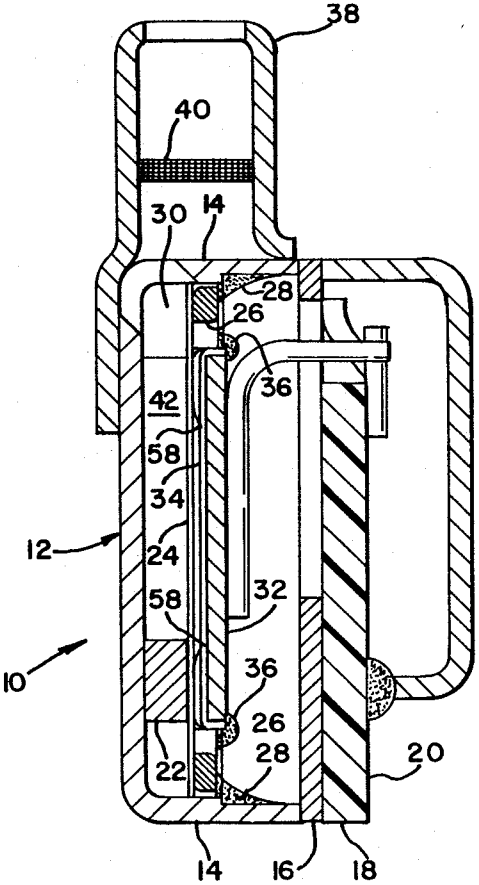
FIG. 1 is a cross-section side view of the microphone assembly of the present invention.

Referring now to FIGS. 1 and 2 it will be seen that sound (indicated by arrows F) enters through an inlet tube 38, the tube providing inertance to the incoming sound, the sound thereafter entering the inlet port 30. A damping element or filter 40 adds a chosen acoustical resistance to the structure. Thereafter the incoming sound travels across the inner chamber (excitation chamber) 42 formed between the diaphragm 24 and the arms 44,46 of the U-shaped plate 22, thereby providing energization of the diaphragm 24. Alternately the sound passes through the two side branches (transfer chambers) 48,50 formed between the opposing interior housing walls 52,54 and the arms 44,46 of the U-shaped plate 22 to enter through a bypass port 56 the volume in the housing 12 lying to the right of the diaphragm 24, as shown in FIG. 1, so as to impinge on the rear surface of the diaphragm. This bypass port 56 is made by cutting away a corner of the mounting ring 26 in the vicinity of one corner of the housing 12, as shown in FIG. 2. As a result, this bypass port 56 transmits sound around to the rear (right-hand) surface of the diaphragm 24.

The U-shaped plate 22 also serves to align and space the electret structure during assembly. The backplate 32 is formed as a square planar plate having an outwardly extending protrusion 58 at each corner of the face confronting the diaphragm 24. The electret film 34 is conformingly formed on and around this face. The backplate 32 is alignigly secured to the mounting ring 26 at an intermediate stage of assembly so that the protrusions 58 lightly engage the diaphragm 24. This subassembly is then placed into abutting engagement with the U-shaped plate 22, this element having been already secured to the housing 12. The protrusions 58 thus cause the remaining regions of the backplate 32 to be at a slight standoff distance with respect to the diaphragm 24. Adhesive fillets 36 are then applied.

Because of electrostatic forces arising from the electret film 34, the diaphragm 24 is drawn slightly towards the backplate 32. As a result, the diaphragm 24 is in contact with the U-shaped plate 22 only where the protrusions 58 force it into such contact; at all other points there is no engagement acting so as to immobilize the diaphragm 24. The spacing between the U-shaped plate 22 and the diaphragm 24 is, however, sufficiently small so as to prevent appreciable sound leakage from the inner chamber 42 to the outer side branches 48,50 which would degrade the performance of the network.

The dimensions of the various channels, apertures, and ports, the compliance of diaphragm 24, the acoustical resistance of element 50, and the relative volumes of the various chambers and branches are arranged so that at low frequencies a substantial replication of the pressure excitation delivered to the diaphragm 24 from the incoming sound is provided via the bypass port 56 to the rear surface of the main diaphragm 24, thereby materially reducing the excitation pressure in such lower frequency ranges. By this means the microphone is rendered relatively unresponsive to low frequency sound. At higher frequencies, however, significant attenuation of this feed-around occurs because of the frequency-dependent acoustical attenuating properties of the coupling passages, with the result that at these higher frequencies this pressure cancellation effect is largely lost. As a result of this, at these higher frequencies the microphone sensitivity is materially augmented.

Considering the various acoustical elements in more detail, at low frequencies sound is relatively unimpeded by small clearances, and is of roughly equal magnitude on both sides of the transducer diaphragm 24. At a well controlled intermediate frequency the inertia of the air flowing in the remainder of the sound path through the channels 48,50 formed by the U-shaped plate 22 causes a resonant condition which acoustically seals off this path for all higher frequencies. This produces a steep rise in the frequency response as the frequency increases. As shown in FIG. 2 the transducer diaphragm 24 and U-shaped plate 22 form two branches 48,50 of narrow dimension having proximal ends 61 and distal ends 63. As the cross sections of the branches are small, there is restriction to sound flow along the length of these channels, which are also acoustically shunted at each point by a portion of the diaphragm 24. These branches 48,50 thus behave as a distributed transmission line. Sound then travels to the opposite surface of the diaphragm 24 via the bypass port 56. At higher frequencies this feed-around action is greatly attenuated, such attenuation arising to a considerable degree because of inertial and resistance effects experienced by sound traveling through the restricted passages 48,50.

Inertial effects arise in general from the necessary pressure differential required to accelerate a column of air confined within an acoustical conduit. Quantitatively this phenomenon is referred to as inertance. The inertance per unit length of a given conduit is proportional to the density of air and inversely proportional to the cross-section area of the conduit. Resistance effects are inherently dissipative, and arise from viscous drag at the walls of the conduit, such drag giving rise to a pressure differential.

Clearly, at frequencies sufficiently low that inertance effects in a given conduit may be ignored, resistance effects may still play a role. In general, the resistance per unit length of a given conduit will typically be strongly governed by the minimum dimension thereof, e.g., the separation between the diaphragm and casing wall. Although the actual equivalent circuit of the microphone assembly 10 is quite complex, certain general observations may nevertheless be made.

The first is that the resonant frequency, i.e., the frequency at which the compensating sound pressure that is fed around to the rear of the diaphragm 24 becomes severely attenuated, is strongly governed by the product of the compliance of the diaphragm added to the compliance of the volume of the chamber on the undriven side of the diaphragm and the effective inertance of the acoustical passages supplying sound energy to it. Also, the amount of attenuation at frequencies well above the resonant point will also be governed by resistances of the port 56 and various relevant conduits. It is clear that additional resistance and inertance effects may be provided by similarly adjusting the standoff distance between the arms 46,44 and their confronting walls 52,54. This plate 22 may be eliminated, and the diaphragm 24 may be correspondingly moved closer to the face of the main housing 12; however, the resonant frequency rises as a result of this, since the passage width becomes the entire transverse width of the housing interior.

By using such a U-shaped plate 22 to add significantly to the acoustical path length, sufficient inertance is provided to achieve the desired high frequency emphasis with a resonant peak at approximately 2 kilohertz in a reduced dimension microphone assembly, in accordance with a design objective of the instant invention.

It will further be appreciated that the two transfer chambers 48,50 are acoustically in parallel, yielding a total inertance less than that of either chamber alone. If additional inertance is desired, this may be accomplished simply by configuring the plate 22 so that one transfer chamber is blocked from communicating with the excitation chamber 42, or by alternative configurations removing one of the two branches 48,50 from the acoustical network.

The response of the microphone assembly 10 described hereinabove is generally of steeply rising characteristic, and similar to that of microphone assemblies existent in present art. It has a resonant frequency of approximately 2 kilohertz. This behavior is, however, achieved in a structure substantially smaller than present art allows, for reasons outlined hereinabove. The case dimensions (exclusive of the inlet tube 38) of the assembly 10 shown in the figures are approximately 3.6 by 3.6 by 2.3 millimeters.

I claim:

1. A frequency-compensated hearing aid microphone assembly for providing from incoming ambient sound a frequency-varying differential actuating pressure to a transducer-operating diaphragm comprising:

a hollow housing having housing walls defining a main chamber therein;

a compliant diaphragm disposed to divide the interior of said main chamber into a first chamber on a first side of said diaphragm and a second chamber on the second side of said diaphragm;

transducing means responsive to the movement of said diaphragm for producing an electrical signal responsively to said movement;

acoustically isolating chamber partition means disposed in said first chamber between the central region of said diaphragm and one or more confronting inner walls of said first chamber to acoustically divide said first chamber into an excitation chamber confronting said central region of said diaphragm and one or more elongated inertance-forming transfer chambers peripheral thereto and having first and second ends;

input port means configured to deliver incoming ambient sound to said excitation chamber;

transfer chamber inlet port means acoustically communicating between said excitation chamber and said first ends of each said transfer chamber; and transfer chamber outlet port means acoustically communicating between said second chamber and and a portion of each said transfer chamber remote from said first end thereof.

2. The microphone assembly of claim 1 wherein said first chamber is generally rectangular and said partition means includes a member configured as a generally U-shaped plate having two parallel arms and a joining region and disposed generally partially surrounding said central region of said diaphragm so that at least said arms form a pair of such inertance-forming elongated transfer chambers in conjunction with their respective confronting first chamber walls, each said transfer chamber having a proximal end generally proximate to said input port means and acoustically communicating at its opposite end with said transfer chamber outlet port means, the ends of said arms being configured to provide acoustical communication between their associated transfer chambers and said excitation chamber.

3. The microphone assembly of claim 2 wherein said main chamber has parallel major confronting walls, said U-shaped plate is sealingly secured at one major face thereof to the interior surface of one of said major walls, and said diaphragm is disposed with peripheral portions thereof in abutting contact with at least portions of the opposite major face of said plate to be spacingly alignly positioned within said main chamber.

4. The microphone assembly of claim 1 wherein said transfer chamber outlet port means is configured to acoustically communicate between said second chamber and said second ends of said transfer chambers.

5. The microphone assembly of claims 1, 2, 3, or 4 wherein said input port means is configured to deliver said ambient sound to said excitation chamber at a point proximate to an edge of said diaphragm.

6. The microphone assembly of claims 1, 2, or 3 wherein said input port means includes acoustical damping means disposed to present an acoustical resistance to the transmission of ambient sound to said diaphragm.

7. The microphone assembly of claim 5 wherein said transfer chamber outlet port means is configured to acoustically communicate between said second chamber and said second ends of said transfer chambers.

8. The microphone assembly of claim 6 wherein said transfer chamber outlet port means is configured to acoustically communicate between said second chamber and said second ends of said transfer chambers.

* * * * *